US011747022B2

(12) United States Patent
Cowan et al.

(10) Patent No.: US 11,747,022 B2
(45) **Date of Patent: *Sep. 5, 2023**

(54) COOKING APPLIANCE WITH UNINTENTIONAL CONTROL ACTIVATION DETECTION

(71) Applicant: Midea Group Co., Ltd., Foshan (CN)

(72) Inventors: Richard W. Cowan, Louisville, KY (US); John Kenneth Hooker, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/489,993

(22) Filed: Sep. 30, 2021

(65) Prior Publication Data

US 2023/0097503 A1 Mar. 30, 2023

(51) Int. Cl.
*F24C 3/12* (2006.01)
*F23N 1/00* (2006.01)

(52) U.S. Cl.
CPC ..... *F24C 3/126* (2013.01); *F23N 1/005* (2013.01); *F24C 3/124* (2013.01); *F23N 2223/08* (2020.01); *F23N 2223/22* (2020.01); *F23N 2241/08* (2020.01)

(58) Field of Classification Search
CPC ..... F23N 5/245; F24C 3/126; F24C 7/082; G08B 21/182
USPC ..... 126/1 R, 39 R, 42, 39 BA, 39 E
See application file for complete search history.

(56) References Cited

U.S. PATENT DOCUMENTS

| | | | |
|---|---|---|---|
| 3,529,584 | A | 9/1970 | Celaya |
| 4,681,084 | A | 7/1987 | Grech |
| 5,094,259 | A | 3/1992 | Hsu |
| 5,787,874 | A | 8/1998 | Krohn et al. |

(Continued)

FOREIGN PATENT DOCUMENTS

| | | |
|---|---|---|
| CN | 104500830 | 4/2015 |
| CN | 204459413 | 7/2015 |

(Continued)

OTHER PUBLICATIONS

United States Patent and Trademark Office, Non-Final Office Action issued in U.S. Appl. No. 17/111,937, 30 pages, dated Aug. 1, 2022.

(Continued)

*Primary Examiner* — Vivek K Shirsat
(74) *Attorney, Agent, or Firm* — Gray Ice Higdon

(57) ABSTRACT

A cooking appliance that includes: a gas cooking element; an igniter located next to the gas cooking element to ignite the gas cooking element; a gas valve for regulating gas flow to the gas cooking element; a burner control coupled to the gas valve to vary the gas flow to the gas cooking element; and a control circuit coupled to the burner control and for activating the igniter when the burner control is positioned within a predetermined range of positions, where the control circuit detects when the burner control has been moved through the predetermined range of positions in less than a predetermined time, and in response to determining that the burner control has been moved through the predetermined range of positions in less than the predetermined time, generate an alert to a user.

19 Claims, 5 Drawing Sheets

(56) References Cited

U.S. PATENT DOCUMENTS

| | | | | |
|---|---|---|---|---|
| 6,619,613 | B1 | 9/2003 | Akamatsu et al. | |
| 7,428,901 | B2 | 9/2008 | Gama et al. | |
| 7,527,072 | B2 | 5/2009 | Crnkovich | |
| 7,568,909 | B2 | 8/2009 | MacNutt et al. | |
| 8,100,121 | B2 | 1/2012 | Clauss et al. | |
| 8,766,116 | B2 | 7/2014 | Barrena et al. | |
| 9,004,058 | B1 | 4/2015 | Brown | |
| 9,068,752 | B2 | 6/2015 | Shaffer et al. | |
| 9,709,284 | B2 | 7/2017 | Bach et al. | |
| 9,746,186 | B2 | 8/2017 | Moro et al. | |
| 9,765,966 | B2 | 9/2017 | Herzog | |
| 10,344,984 | B2 | 7/2019 | Golomb | |
| 10,504,673 | B2 * | 12/2019 | Cha | H01H 19/14 |
| 11,441,782 | B2 * | 9/2022 | Cowan | F23N 5/245 |
| 2010/0216080 | A1 | 8/2010 | Home | |
| 2010/0253653 | A1 | 10/2010 | Stambaugh et al. | |
| 2012/0247452 | A1 | 10/2012 | Pianezze | |
| 2012/0285243 | A1 | 11/2012 | Yamamoto | |
| 2013/0260320 | A1 | 10/2013 | Townsend | |
| 2014/0001173 | A1 | 1/2014 | Holzgreve | |
| 2015/0037737 | A1 | 2/2015 | Pottenger et al. | |
| 2015/0193073 | A1 | 7/2015 | Dmytriw et al. | |
| 2016/0348916 | A1 * | 12/2016 | French | F16K 31/524 |
| 2017/0238751 | A1 | 8/2017 | Vengroff | |
| 2018/0245795 | A1 | 8/2018 | Serabatir | |
| 2020/0011534 | A1 | 1/2020 | Park et al. | |
| 2020/0103110 | A1 | 4/2020 | Buescher et al. | |
| 2022/0178538 | A1 | 6/2022 | Cowan et al. | |
| 2022/0178547 | A1 | 6/2022 | Cowan et al. | |

FOREIGN PATENT DOCUMENTS

| | | |
|---|---|---|
| CN | 206648088 | 11/2017 |
| CN | 108019800 | 5/2018 |
| GB | 1493580 | 11/1977 |
| JP | S57108525 | 7/1982 |
| JP | H0391618 | 4/1991 |
| JP | 2001059618 | 3/2001 |
| KR | 200477877 Y1 | 8/2015 |

OTHER PUBLICATIONS

BurnerAlert, BurnerAlert Stove Reminder Disc, Amazon.com, Retrieved from:https://www.amazon.com/BurnerAlert-Stove-Reminder-Color-White/dp/B07PP7P9S3, Retrieved on Apr. 6, 2021.

Day, Lewin, Stove Alarm Keeps the Kitchen Safe, Retrieved from: https://hackaday.com/2018/12/09/stove-alarm-keeps-the-kitchen-safe/, Dec. 9, 2018.

Shirsat, Vivek K., United States Patent and Trademark Office, Final Office issued in U.S. Appl. No. 17/111,929, 23 pages, dated Nov. 9, 2022.

United States Patent and Trademark Office, Office Action issued in U.S. Appl. No. 17/111,929, 30 pages, dated Jul. 20, 2022.

Related Applications Transmittal, dated Oct. 8, 2021.

Shirsat, Vivek K., United States Patent and Trademark Office, Notice of Allowance issued in U.S. Appl. No. 17/111,937, 21 pages, dated Sep. 21, 2022.

United States Patent & Trademark Office; Notice of Allowance issued in U.S. Appl. No. 17/111,929 dated Mar. 14, 2023.

* cited by examiner

COOKING APPLIANCE WITH UNINTENTIONAL CONTROL ACTIVATION DETECTION

BACKGROUND

Cooking appliances such as cooktops or ranges have a variety of control or selector knobs for adjusting and controlling the amount of heat supplied to various appliance burners or cooking elements. For burners that rely on combustible gas such as natural gas or liquefied petroleum (LP) gas (also referred to as propane), turning a control knob generally causes a gas valve to be opened to supply gas to an associated gas burner, and energizes a switch through the first part of the range of the knob's rotation to spark an igniter in this range of rotation igniting the gas flowing out of the gas valve.

One concern that arises with appliances, such as cooktops and ranges, is the risk of unintentional opening of the gas valve. Such unintentional incidents may be caused, for example, by the user, a jumping pet, a playing child, and/or someone not aware that they bumped into or otherwise turned the associated control knob. This may occur even though typical burners usually include a two-manual-operation protocol to energize a burner (e.g., pushing and turning of the corresponding control knob). Another concern that may arise is that a user may rotate the knob quickly beyond the range in which the switch is energized, which may leave the gas valve in an open state with no flame. In some instances, the user may not realize gas is flowing without a flame because the burner is covered by a large pan.

Thus, there is a need to reduce the inadvertent operation (e.g. on, off, open, close, shift, move, etc.) of appliance controls, or portions thereof, as well as to alert the user(s) or people in the surrounding area of the fact that one or more burner controls have been activated.

SUMMARY

The herein-described embodiments address these and other problems associated with the art by providing an alert to a user of a potential unintentional control activation for a cooking appliance at least in part based upon the amount of time that the control is within an ignition range of the control. In some instances, for example, unintentional control activation may be detected based upon a control being moved within the ignition range too quickly, while in other instances, unintentional control activation may be detected based upon a control being in an ignition range for an excessive amount of time.

Therefore, consistent with one aspect of the invention, a cooking appliance may include a gas cooking element, an igniter disposed adjacent to the gas cooking element to ignite the gas cooking element, a gas valve configured to regulate gas flow to the gas cooking element, a burner control coupled to the gas valve to vary the gas flow to the gas cooking element, and a control circuit coupled to the burner control and configured to activate the igniter when the burner control is positioned within a predetermined range of positions. The control circuit is further configured to detect when the burner control has been moved through the predetermined range of positions in less than a predetermined time, and in response to determining that the burner control has been moved through the predetermined range of positions in less than the predetermined time, generate an alert to a user.

In some embodiments, the burner control is a rotary control knob rotatable within the range of positions. In addition, in some embodiments, the control circuit is further configured to adjust the predetermined time based on user input. Also, in some embodiments, the control circuit includes a switch that switches between first and second states, the switch coupled to the burner control and configured to be in the first state when the burner control is in the predetermined range of positions and to be in the second state when the burner control is not in the predetermined range of positions, and the control circuit is configured to detect when the burner control has been moved through the predetermined range of positions in less than the predetermined time by determining a time that the switch is in the first state.

Moreover, in some embodiments, the predetermined range of positions is an ignition range of positions, and the switch is configured to activate the igniter when the burner control is in the ignition range of positions. Further, in some embodiments, the switch is a first switch and the control circuit includes a second switch that switches between first and second states, the second switch coupled to the burner control and configured to be in the first state when the burner control is in an active range of positions for the burner control and to be in the second state when the burner control is not in the active range of positions. Also, in some embodiments, the second switch is configured to activate an on indicator when the burner control is in the active range of positions. Further, in some embodiments, the control circuit is configured to generate the alert only when the control circuit detects that the second switch is in the second state when the burner control moves into the ignition range of positions.

In some embodiments, the control circuit includes a timer configured to detect a time that the switch is in the first state. Also, in some embodiments, the control circuit is further configured to detect a direction of movement of the burner control and to generate the alert only when the direction of movement indicates that the burner control is being turned in a first direction.

In some embodiments, the control circuit is further configured to, in response to determining that the burner control has been moved through the predetermined range of positions in less than the predetermined time, disable flow of gas to the gas cooking element from the gas valve. Further, in some embodiments, the control circuit is further configured to keep the alert actuated for a second predetermined time, and determine whether an alert deactivation is triggered during the second predetermined time, and no alert deactivation is triggered during the second predetermined time, disable the gas cooking element. In some embodiments, the control circuit is configured to generate the alert by generating an audible alert. Further, in some embodiments, the control circuit is configured to generate the alert by generating a visual alert.

Consistent with another aspect of the invention, a cooking appliance may include a gas cooking element, an igniter disposed adjacent to the gas cooking element to ignite the gas cooking element, a gas valve configured to regulate gas flow to the gas cooking element, a burner control coupled to the gas valve to vary the gas flow to the gas cooking element, and a control circuit coupled to the burner control and configured to activate the igniter when the burner control is positioned within a predetermined range of positions. The control circuit further is configured to detect a time the burner control is in the predetermined range of positions, and in response to determining that the time the burner control is in the predetermined range of positions meets an alert criterion, generate an alert to a user.

Also, in some embodiments, the control circuit includes a switch that switches between first and second states, the switch coupled to the burner control and configured to be in the first state when the burner control is in the predetermined range of positions and to be in the second state when the burner control is not in the predetermined range of positions, and the control circuit is configured to detect the time the burner control is in the predetermined range of positions by determining a time that the switch is in the first state. In addition, in some embodiments, the control circuit is further configured to detect a direction of movement of the burner control and to generate the alert only when the direction of movement indicates that the burner control is being moved in a first direction.

In some embodiments, the alert criterion is a predetermined length of time, and the control circuit is configured to determine that the time the burner control is in the predetermined range of positions meets the alert criterion by determining that the burner control has been moved through the predetermined range of positions in less than the predetermined length of time. In addition, in some embodiments, the alert criterion is a predetermined length of time, and the control circuit is configured to determine that the time the burner control is in the predetermined range of positions meets the alert criterion by determining that the burner control has been in the predetermined range of positions for longer than the predetermined length of time. Also, in some embodiments, the control circuit is further configured to, in response to determining that the time the burner control is in the predetermined range of positions meets the alert criterion, disable flow of gas to the gas cooking element from the gas valve.

As used herein for purposes of the present disclosure, the term "appliance" should be understood to be generally synonymous with and include any device that consumes electrical power and can be connected to an electrical circuit or battery, for example one used in a residential or commercial setting to accomplish work. The appliances referred to herein may include a plurality of electrically operated components powered by the circuit, the components operable by manipulation of control knobs or selectors. The appliances referred to herein may also include a gas supply or source and one or more gas valves for supplying gas to a burner or cooking element. The appliance gas valves may be controlled by a selector or knob, either directly or indirectly, and the appliance may also include a processor or processors that operate, control and monitor the appliance and the various components and functions thereof referred to throughout this specification.

The terms "knob" or "selector" are used herein generally to describe various devices that are operatively coupled to functional components of the appliance and which may typically, but not exclusively, be operated by hand by a user. Typical control knobs and selectors include but are not limited to gas and electric burner controls, gas and electric oven controls, lighting and timing controls, start and stop controls, switches, sliders, pushbuttons, wheels, levers, and various other functional controls associated with an appliance.

The term "controller" or "processor" is used herein generally to describe various apparatus relating to the operation of the system and the appliances referred to herein. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), programmable logic controllers (PLCs), and field-programmable gate arrays (FPGAs).

A processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present disclosure discussed herein. The terms "program" or "computer program" are used herein in a generic sense to refer to any type of computer code (e.g., software or microcode) that can be employed to program one or more processors or controllers.

The term "Internet" or synonymously "Internet of things" refers to the global computer network providing a variety of information and communication facilities, consisting of interconnected networks using standardized communication protocols. The appliances, controllers and processors referred to herein may be operatively connected to the Internet.

These and other advantages and features, which characterize the disclosure, are set forth in the claims annexed hereto and forming a further part hereof. However, for a better understanding of the disclosure, and of the advantages and objectives attained through its use, reference should be made to the Drawings, and to the accompanying descriptive matter, in which there is described example embodiments of the disclosure. This summary is merely provided to introduce a selection of concepts that are further described below in the detailed description, and is not intended to identify key or essential features of the claimed subject matter, nor is it intended to be used as an aid in limiting the scope of the claimed subject matter.

BRIEF DESCRIPTION OF THE DRAWINGS

In the drawings, like reference characters generally refer to the same parts throughout the different views. The drawings are not necessarily to scale. Emphasis is instead generally placed upon illustrating the principles of the disclosure.

DETAILED DESCRIPTION

The embodiments discussed hereinafter will focus on the implementation of the hereinafter-described techniques and apparatuses within a residential type cooking appliance such as a cooking appliance 10 as described below, such as the type that may be used in single-family or multi-family dwellings, or in other similar applications. However, it will be appreciated that the herein-described techniques and apparatuses may also be used in connection with other types of cooking appliances in some embodiments. For example, the herein-described techniques may be used in commercial applications in some embodiments. Moreover, the herein-described techniques may be used in connection with various cooking appliance configurations. Implementation of the herein-described techniques within gas/electric top burners, gas/electric ranges, slide-in ovens, freestanding ovens, gas/electric cooktops, gas/electric countertop ranges, etc. using a gas/electric burner or cooking surface would be well within the abilities of one of ordinary skill in the art having the benefit of the instant disclosure, so the embodiments are not limited to the residential-type range implementation discussed further herein.

Figure 1:
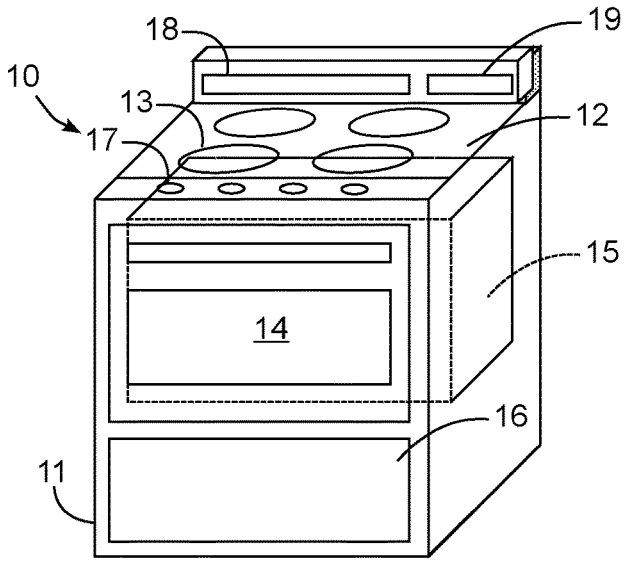
FIG. 1 is a perspective view of a cooking appliance consistent with some embodiments of the invention.

Turning now to the drawings, wherein like numbers denote like parts throughout the several views, FIG. 1 illustrates an example cooking appliance 10 in which the various technologies and techniques described herein may be implemented. Cooking appliance 10 is a residential-type range, and as such includes a housing 11, a stovetop or cooktop 12 including a plurality of burners 13, and an oven 14 defining an oven or cooking cavity 15 accessed via an oven door. Cooking appliance 10 may also include a storage drawer 16 in some embodiments, or in other embodiments, may include a second oven. Various cooking elements (not shown in FIG. 1) may also be incorporated into cooking appliance 10 for cooking food in oven 14, e.g., one or more electric or gas heating elements. In some embodiments, cooktop 12 may include one or more cooking grates (not shown) thereon. The cooking grate may support a cooking vessel or cookware (not shown) over burner 13.

Cooking appliance 10 may also include various user interface devices, including, for example, control knobs 17 for controlling burners 13, a control panel 18 for controlling oven 14 and/or burner 13, and a display 19 for providing visual feedback as to the activation state of the cooking appliance. It will be appreciated that cooking appliance 10 may include various types of user controls in other embodiments, including various combinations of switches, buttons, knobs and/or sliders, typically disposed at the rear or front (or both) of the cooking appliance. Further, in some embodiments, one or more touch screens may be employed for interaction with a user. As such, in some embodiments, display 19 may be touch sensitive to receive user input in addition to displaying status information and/or otherwise interacting with a user. In other embodiments, cooking appliance 10 may be controllable remotely, e.g., via a smartphone, tablet, personal digital assistant or other networked computing device, e.g., using a web interface or a dedicated app.

Display 19 may also vary in different embodiments, and may include individual indicators, segmented alphanumeric displays, and/or dot matrix displays, and may be based on various types of display technologies, including LEDs, vacuum fluorescent displays, incandescent lights, etc. Further, in some embodiments audio feedback may be provided to a user via one or more speakers, and in some embodiments, user input may be received via a spoken or gesture-based interface.

As noted above, cooking appliance 10 of FIG. 1 may be a range, which combines both a stovetop and one or more ovens, and which in some embodiments may be a standalone or drop-in type of range. In other embodiments, however, cooking appliance 10 may be another type of cooking appliance, e.g., a cooktop without a separate oven. In general, a cooking appliance consistent with the disclosure may be considered to include any residential-type appliance including a housing and one or more cooking elements disposed therein and configured to generate energy for cooking food on a cooktop and/or within one or more oven cavities.

In turn, a cooking element may be considered to include practically any type of energy-producing element used in residential applications in connection with cooking food, e.g., employing various cooking technologies such as electric, gas, light, microwaves, induction, convection, radiation, etc. In the case of an oven, for example, one or more cooking elements therein may be gas, electric, light, or microwave heating elements in some embodiments, while in the case of a stovetop, one or more cooking elements therein may be gas, electric, or inductive heating elements in some embodiments. Further, it will be appreciated that any number of cooking elements may be provided in a cooking appliance (including multiple cooking elements for performing different types of cooking cycles such as baking or broiling), and that multiple types of cooking elements may be combined in some embodiments, e.g., combinations of microwave and light cooking elements in some oven embodiments.

Figure 2:
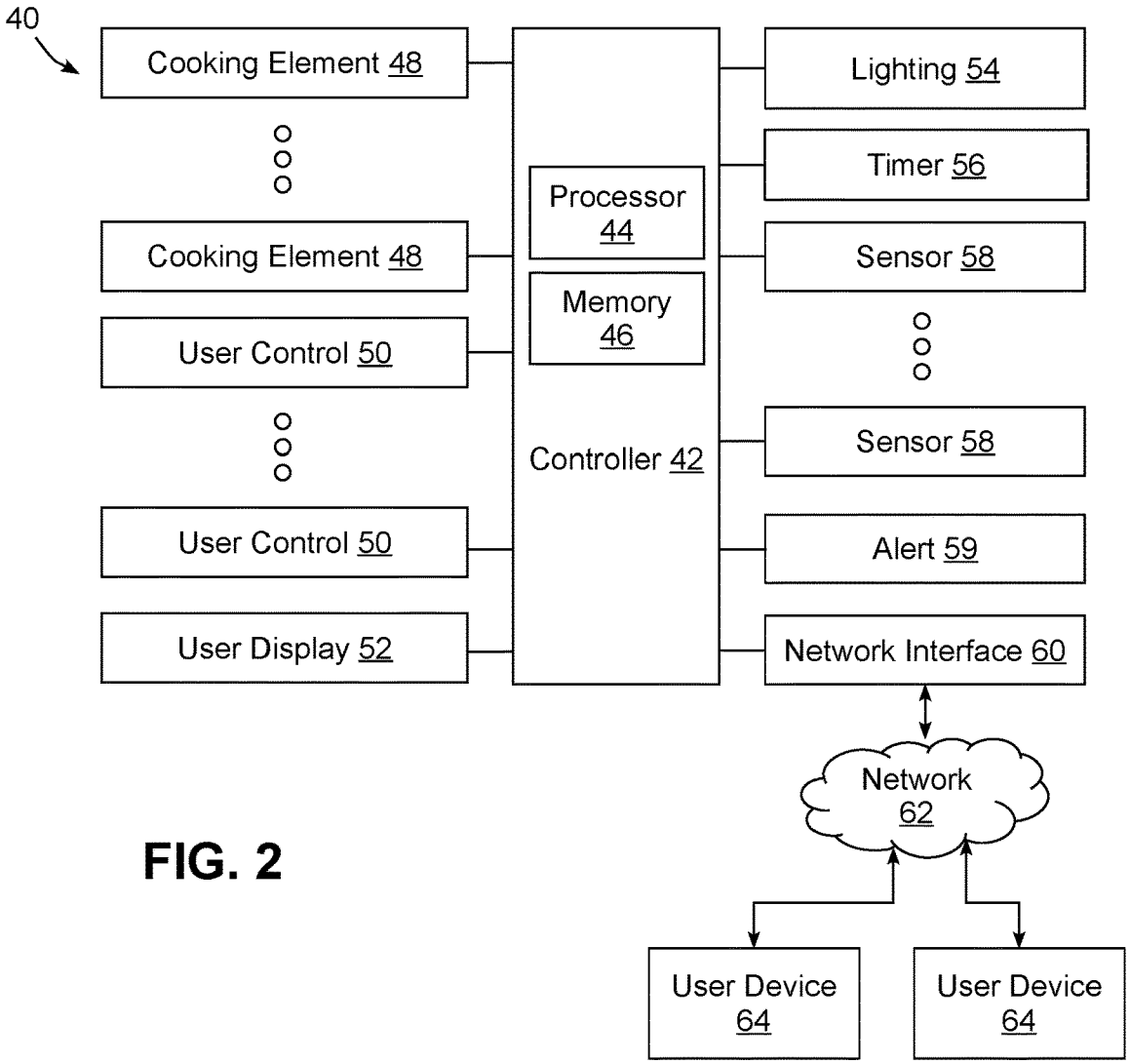
FIG. 2 is a block diagram of an example control system for a cooking appliance consistent with some embodiments of the invention.

A cooking appliance consistent with the disclosure also generally includes one or more controllers configured to control the cooking elements and otherwise perform cooking operations at the direction of a user. FIG. 2, for example, illustrates an example embodiment of a cooking appliance 40 including a controller 42 that receives inputs from a number of components and drives a number of components in response thereto. Controller 42 may, for example, include one or more processors 44 and a memory 46 within which may be stored program code for execution by the one or more processors. The memory may be embedded in controller 42, but may also be considered to include volatile and/or non-volatile memories, cache memories, flash memories, programmable read-only memories, read-only memories, etc., as well as memory storage physically located elsewhere from controller 42, e.g., in a mass storage device or on a remote computer interfaced with controller 42. The processor 44 may be any hardware device capable of executing instructions stored in memory 46 or otherwise processing data. As such, the processor may include a microprocessor, field programmable gate array (FPGA), application-specific integrated circuit (ASIC), or other similar devices.

The memory 46 may include various memories such as, for example L1, L2, or L3 cache or system memory. As such, the memory 46 may include static random access memory (SRAM), dynamic RAM (DRAM), flash memory, read only memory (ROM), or other similar memory devices. It will be apparent that, in embodiments where the processor includes one or more ASICs (or other processing devices) that implement one or more of the functions described herein in hardware, the software described as corresponding to such functionality in other embodiments may be omitted.

As shown in FIG. 2, controller 42 may be interfaced with various components, including various cooking elements 48 used for cooking food (e.g., various combinations of gas, electric, inductive, light, microwave, light cooking elements, among others), one or more user controls 50 for receiving user input (e.g., various combinations of switches, knobs, buttons, sliders, touchscreens or touch-sensitive displays, microphones or audio input devices, image capture devices, etc.), and a user display 52 (including various indicators, graphical displays, textual displays, speakers, etc.), as well as various additional components suitable for use in a cooking appliance, e.g., lighting 54 and/or one or more fans (e.g., convection fans, cooling fans, etc.), among others.

Controller 42 may also be interfaced with various sensors 58 located to sense environmental conditions inside of and/or external to cooking appliance 40, e.g., one or more temperature sensors, humidity sensors, air quality sensors, smoke sensors, carbon monoxide sensors, odor sensors and/or electronic nose sensors, among others. Such sensors may be internal or external to cooking appliance 40, and may be coupled wirelessly to controller 42 in some embodiments. Sensors 58 may include, for example, one or more temperature sensors for sensing an air temperature within an oven cavity.

In some embodiments, controller 42 may also be coupled to one or more network interfaces 60, e.g., for interfacing with external devices via wired and/or wireless networks such as Ethernet, Wi-Fi, Bluetooth, NFC, cellular and other suitable networks, collectively represented in FIG. 2 at 62. Network 62 may incorporate in some embodiments a home automation network, and various communication protocols may be supported, including various types of home automation communication protocols. In other embodiments, other wireless protocols, e.g., Wi-Fi or Bluetooth, may be used. In some embodiments, cooking appliance 40 may be interfaced with one or more user devices 64 over network 62, e.g., computers, tablets, smart phones, wearable devices, etc., and through which cooking appliance 40 may be controlled and/or cooking appliance 40 may provide user feedback. For example, network interface 60 may include a network interface card (NIC) configured to communicate according to the Ethernet protocol. Additionally, network interfaces 60 may implement a TCP/IP stack for communication according to the TCP/IP protocols. Various alternative or additional hardware or configurations for network interface 60 will be apparent to one of ordinary skill in the art.

In some embodiments, controller 42 may be interfaced with one or more timers 56 to measure a length of time, for example the length of time one or more switches are in a "on" state, as described in detail herein. Such a timer may be a hardware timer or may be a software timer (e.g., implemented in processor 44). For example, a cam system may engage the timer to begin timing whenever the user control 50 is enters an energized range triggering an igniter.

In some embodiments, controller 42 may be interfaced with one or more alerts 59 to indicate to a user regarding various conditions of cooking appliance 40 (e.g., energization/de-energization conditions inside of and/or external to cooking appliance 40). For example, alert 59 may communicate to the user (and/or a device concurrently with a cooking element) that the gas valve has been in an ignition position (e.g., unintentionally and/or intentionally activated from off position to on position) for a period of time sufficient to meet an alert criterion. Alert 59 may be a variety of signals and/or warnings (e.g., audible/acoustic, visual, light, display message, user interface, haptic alert, or a combination thereof) directed to one or more users or to one or more devices (e.g., appliances, mobile device, cooking appliance, etc.). Alert 59 may remain continually active until deactivated by the user and/or a certain predetermined parameter/condition of appliance 40 or controller 42 is met. Such alert 59 may be internal or external to cooking appliance 40 and coupled wirelessly to controller 42 in some embodiments.

In some embodiments, controller 42 may operate under the control of an operating system and may execute or otherwise rely upon various computer software applications, components, programs, objects, modules, data structures, etc. In addition, controller 42 may also incorporate hardware logic to implement some or all of the functionality disclosed herein. Further, in some embodiments, the sequences of operations performed by controller 42 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the disclosure applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the disclosure is not limited to the particular sequences of operations described herein.

Numerous variations and modifications to the cooking appliances illustrated in FIGS. 1-2 will be apparent to one of ordinary skill in the art, as will become apparent from the description below. Therefore, the disclosure is not limited to the specific implementations discussed herein.

Unintentional Control Activation Detection

As noted above, one challenge associated with the operation of cooking appliances is the inadvertent operation of burner controls. Embodiments consistent with the disclosure address this challenge in part by providing an alert to a user when it is detected that burner control is in the ignition range for a period of time sufficient to meet an alert criterion. In response to determining that the amount of time the burner control is in the ignition state meets the alert criterion, a control circuit or controller may be configured to generate an alert for a user (and/or in some implementations deactivate the cooking element).

For example, in some instances, when it is detected that the burner control in is in the ignition range for less than a predetermined time, which may indicate a user moved the knob/slider through the ignition state too fast and the flame was not lit, an alert may be trigged to warn the user of the movement and/or that ignition did not occur. It will be appreciated, for example, that if a burner control is bumped into by a user or pet, one possible scenario that may occur is that the control quickly moves from an off position, completely through the ignition range, and then to a fully on position, potentially in only a fraction of a second, and in all likelihood before sufficient gas flow and sparking could be generated to ignite the burner. As such, by detecting when the time to move through the ignition range is less than a relatively short threshold (e.g., less than a second), an alert may be generated to indicate to a user that the burner control is in the on position and potentially releasing gas into the room.

Alternatively, or additionally, when it is detected that the burner control in is in the ignition range for more than a predetermined time, which may indicate an inadvertent movement of the knob/slider into the ignition state, an alert may also be trigged to warn the user of the movement. It will be appreciated, for example, that if a burner control is bumped into by a user or pet, another possible scenario that may occur is that the control moves only far enough to be left in the ignition range, which would result in continuous sparking, and if the burner control is moved to a position in which sufficient gas flow is established, the burner may also be ignited. As such, by detecting when the time to move through the ignition range is greater than a relatively long threshold (e.g., about 4 or more seconds), an alert may be generated to indicate to a user that the burner control has been left in an ignition position.

Figure 3:
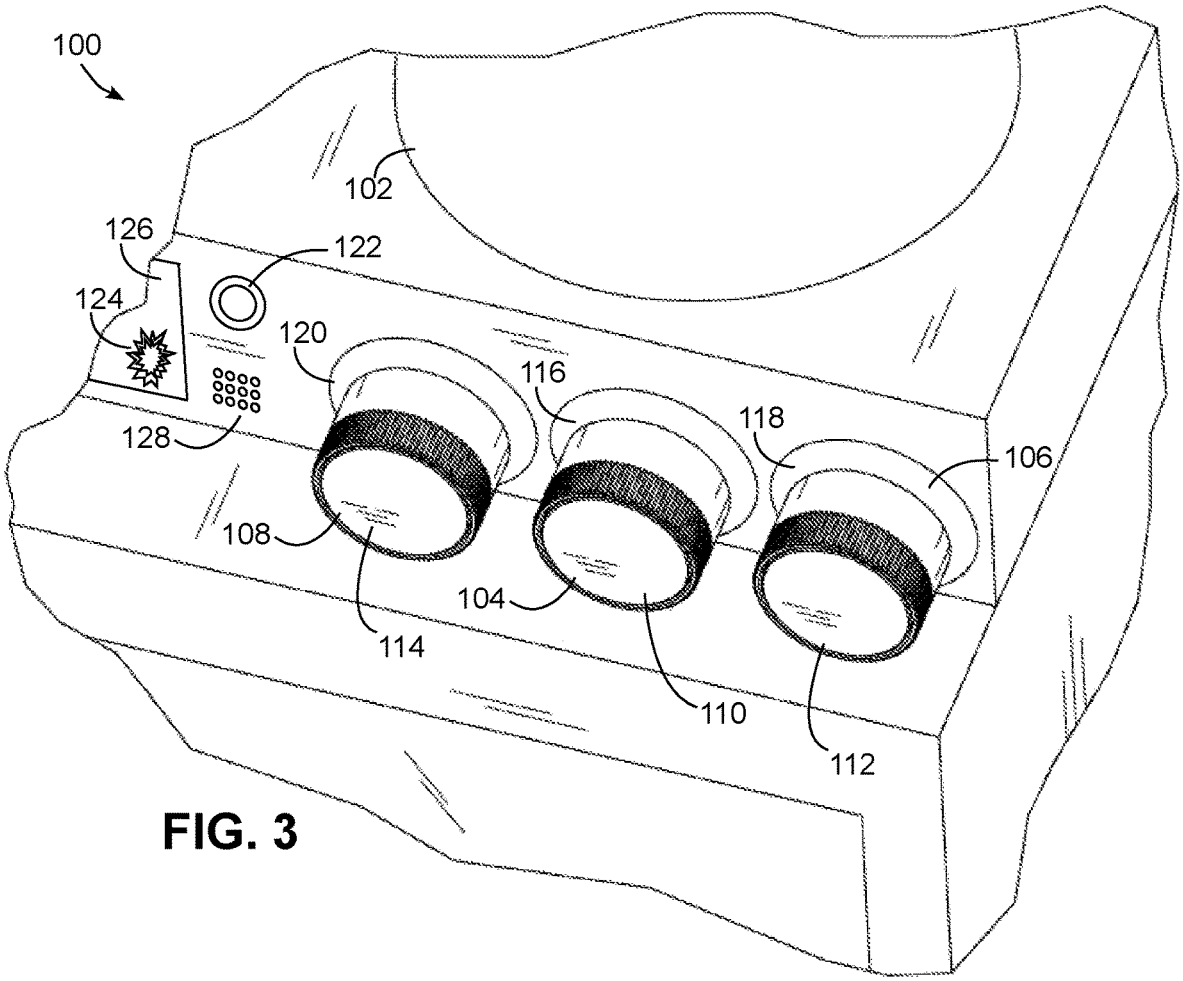
FIG. 3 is a partial perspective view of a cooking appliance implementing rotary burner control of mechanical valve units consistent with some embodiments of the invention.
Figure 4:
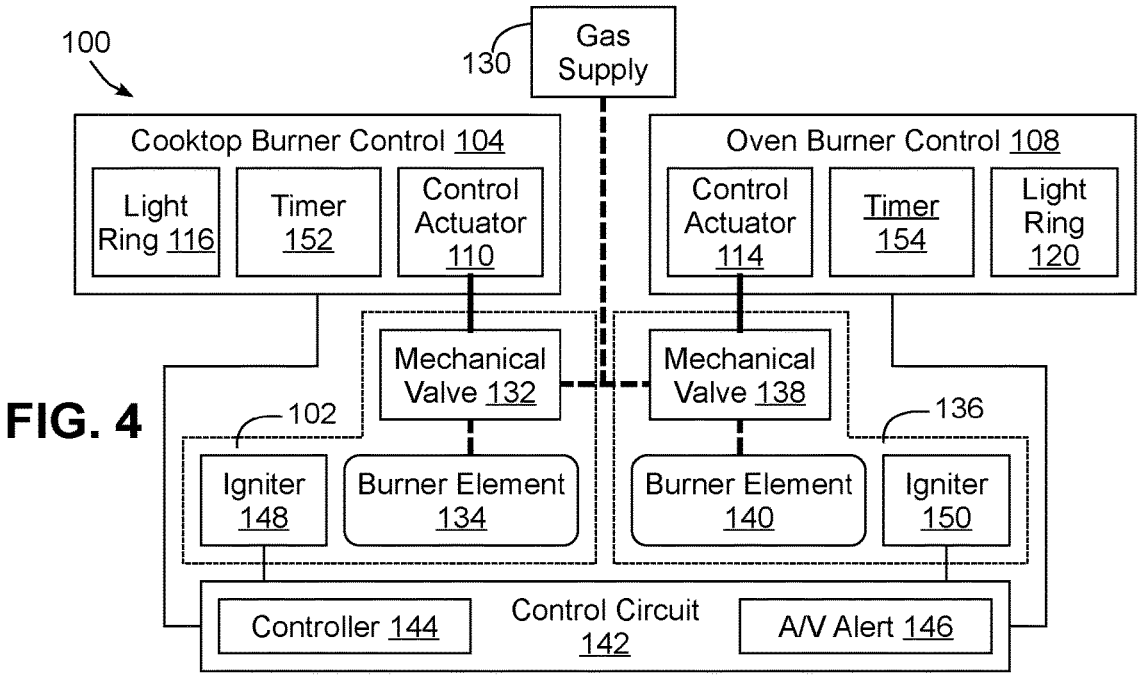
FIG. 4 is a block diagram of an example control system for the cooking appliance of FIG. 3.

In some embodiments, and as illustrated in FIGS. 3-4, a gas burner may be controlled by a mechanical valve that is mechanically coupled to a control actuator such as a knob or slider. FIG. 3, in particular, illustrates a gas range 100 including a gas cooktop burner 102 and a set of burner controls 104, 106, 108, e.g., rotary burner controls, each with a control actuator 110, 112, 114, e.g., a rotary control actuator or knob. In some embodiments, one or more of burner controls 104, 106, 108 may be used to control an oven, rather than a cooktop. In the embodiment discussed below, for example, burner control 104 is used to control gas cooktop burner 102 while burner control 108 is used to control a gas oven burner.

In order to generate alerts to a user, gas range 100 may include various types of electrical indicator devices, e.g., an illuminated light or LED-backlit ring 116, 118, 120 on each burner control 104, 106, 108, a separate, dedicated visual indicator such as an LED 122 on the control panel, an illuminated icon 124 and/or text displayed on a user interface 126, or a speaker 128 for use in generating audible alerts. An alert could also be generated proximate the burner itself, e.g., using a light source positioned close to the burner. An alert, in this regard, may be considered to include any type of visual and/or audible presentation to a user that may be recognized as an alert by a user, and in some instances, an alert may be generated on a device that is remove from a cooking appliance, e.g., on an interconnected smart home device, mobile device, etc. It will also be appreciated that the various alerts 116, 118, 120, 122, 124 and 128 illustrated in FIG. 3 are merely shown on a single device for illustrative purposes, and that a cooking appliance consistent with the invention may utilize as few as one such indicating device, indicator, illumination source, speaker, etc. in some embodiments.

In addition, it will be appreciated that alerts may be generated using devices that may also be used to indicate other status information for a cooking appliance, and that alerts in some embodiments may utilize different colors, animations, patterns, text, graphical images, etc. In one example embodiment, ignition-related alerts may be implemented by light rings 116, 118, 120, and that additional alerts associated with the respective user controls 104, 106, 108 may also be generated using the same light rings 116, 118, 120. For example, a light ring 116, 118, 120 may be used to display a first color or pattern (e.g., a red color and/or a flashing or chasing lights pattern) to represent when the igniter of the associated burner is on or when the control actuator 110, 112, 114 is in an ignition position, and then display a second color or pattern (e.g., a blue color and/or a solid illumination pattern) to represent when the control actuator 110, 112, 114 is in an "on" position.

With further reference to FIG. 4, gas burner 102 may be coupled to a gas supply 130 through a mechanical valve 132 that regulates the flow of gas to a burner element 134, e.g., via a mechanical coupling to control actuator 110 of cooktop burner control 104. Similar valves and burner elements may be used for the other cooktop burners of appliance 100, but are omitted from FIG. 4 for clarity. In addition, where a gas oven is incorporated into cooking appliance 100, one or more gas oven burners 136, each including an associated mechanical valve 138 and burner element 140, may also be used. As illustrated in FIG. 4, mechanical valve 138 is mechanically coupled to control actuator 114 of oven burner control 108.

Control over cooking appliance 100 may be provided by a control circuit 142, which may include a controller 144 in some embodiments. Control circuit 142 may drive one or more audible and/or visual alerts 146 (which may correspond, for example, to any of elements 122, 124 or 128 of FIG. 3) as well as various light rings 116, 120 of burner controls 104, 108. Control circuit 142 may also drive one or more igniters 148, 150, which may be spark in order to ignite gas. Further, in some embodiments, each burner control 104, 108 may include an associated timer 152, 154 that is used to measure a length of time one or more switches are on. Each timer 152, 154 may be implemented using practically any type of timer capable of measuring a length of time, e.g., a hardware timer implemented using a discrete timer circuit, a software timer implemented in a controller, etc. It will be appreciated that while control circuit 142 utilizes a controller 144 in FIG. 4, in some embodiments no controller may be used, with control circuit 142 implemented using only discrete circuit components. In still other embodiments, various functions implemented by control circuit 142 may be implemented using one or both of a controller and discrete circuit components.

Figure 5:
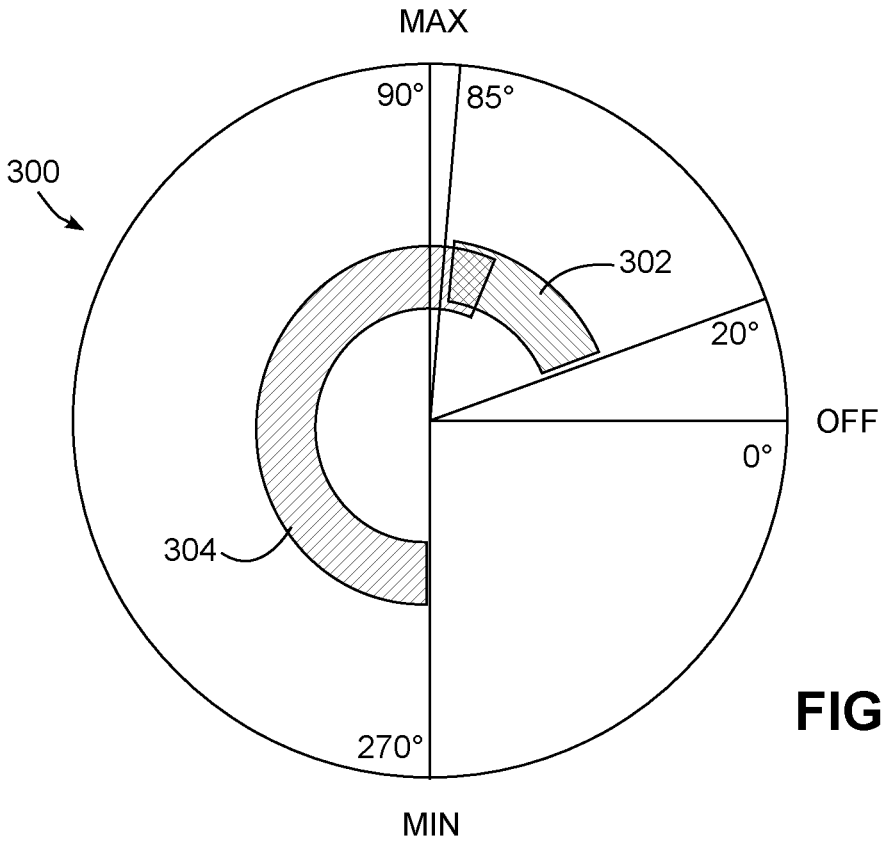
FIG. 5 is a diagram illustrating various positional ranges in the movement of a rotary burner control for a gas cooking appliance.

Now turning to FIG. 5, in some embodiments it may be desirable to provide a user an alert that there was an unintentional activation of a burner control; for example, to indicate to a user that gas is flowing, but may not have been ignited, or if ignited, that the burner is producing a flame but is potentially unattended. As noted above, there may be instances where a knob or burner control is inadvertently activated (e.g. due to being bumped into, jumped on by a pet, etc.); additionally, it may also be difficult for a user to determine is a burner has been ignited, for example this may be due to the size of cookware on a cooktop burner, or the otherwise lack of visibility of an igniter to a user. In some embodiments consistent with the invention, however, it may be desirable to utilize a control circuit in a cooking appliance to generate an alert to a user in connection with the detection, for example through use of a timer, that ignition was not successful, and thereby notify the user that the gas valve is open.

As noted above many gas cooking appliances utilize mechanical gas valves controlled by rotary burner controls that are mechanically coupled to the valves. In general, each mechanical gas valve has an igniter switch attached to the rotary burner control that activates an igniter when a rotary control actuator (such as a knob) is turned beyond (and the gas valve is thus opened) a certain range of rotation in order to ignite the burner.

In order to prevent the flow of unburned gas, the igniter switch is generally designed to change state (and thus initiate sparking) just before the point in the gas valve's rotation when gas begins to flow. The switch is designed to remain in this state to allow sparking to continue until just before the valve reaches its maximum flow position. In many cases, e.g., for a gas valve with a 270 degree range of rotation, this state change generally occurs somewhere around 85 degrees open from the off position. The maximum flow position for the valve is generally about 90 degrees open from the off position, and this is the first position that the user is intended to use for cooking.

FIG. 5, for example, illustrates an example relationship of igniter and gas flow positions for an example mechanical gas valve 300 with 270 degrees of rotational range. Embodiments consistent with the invention, seek to generate an alert to a user whenever a burner control for a gas burner has been activated causing gas to flow from the burner (either inadvertently or intentionally), but there may have been no ignition of the burner. In some embodiments, for example, a burner control may be movable between first, second, third and fourth ranges of positions. In the first range of positions (generally corresponding to the 0 to 20 degree range in the example of FIG. 5), the igniter is inactive and the gas valve supplies substantially no gas flow to the gas burner. In the second and third ranges of positions (generally corresponding to the 20 to 85 degree range in the example of FIG. 5), the igniter is active. However, in the second position, the gas valve may not supply sufficient gas flow to the gas burner to support ignition. In the fourth range of positions (generally corresponding to the 85 to 270 degree range in the example of FIG. 5), the igniter is inactive while the gas valve supplies sufficient gas flow to the gas burner to maintain a flame, generally serving as an operational range where the user is able to regulate an output level of the burner while the burner is active. In the illustrated embodiments, a control circuit is configured to generate an alert to a user when the time spent in the second and/or third ranges of positions meet a predetermined alert criterion. This may alert the user to an inadvertent activation of the ignitor, for example due to an inadvertent activation of the burner control and/or due to progressing through the second and third ranges too quickly, thus not allowing the burner to ignite.

Figure 6:
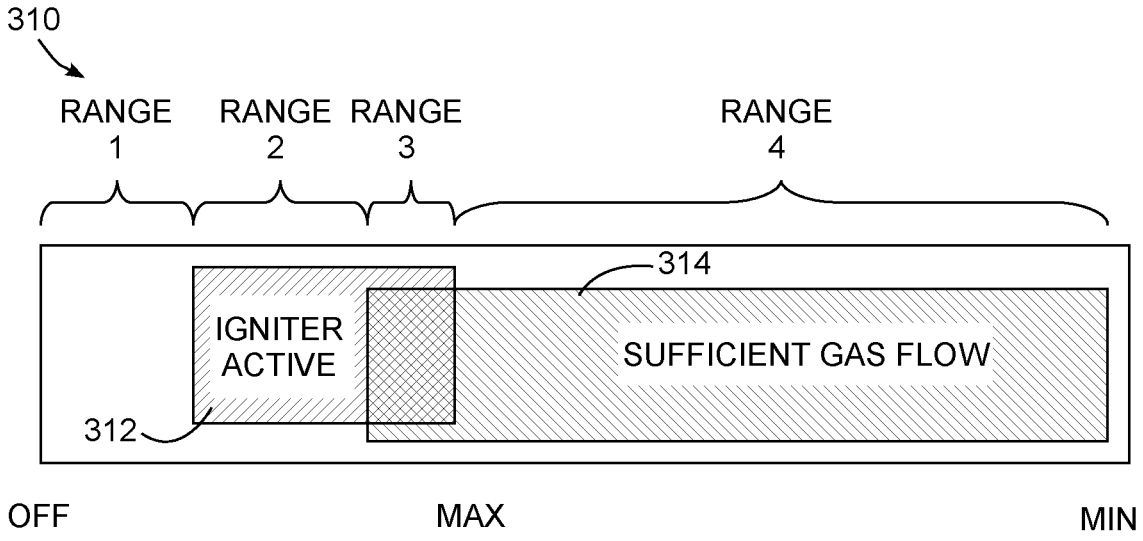
FIG. 6 is a diagram illustrating various positional ranges in the movement of a linear burner control for a gas cooking appliance.

It will be appreciated that a burner control consistent with the invention need not be a rotary control. FIG. 6, for example, illustrates a linear control 310 (e.g., a slider) that may be used in other embodiments. As with rotary burner control 300, however, linear control 310 still supports a range 312 where the igniter is active (ranges two and three), and an operational range 314 where the user regulates the output level of the burner while in an active state (range four).

Figure 7:
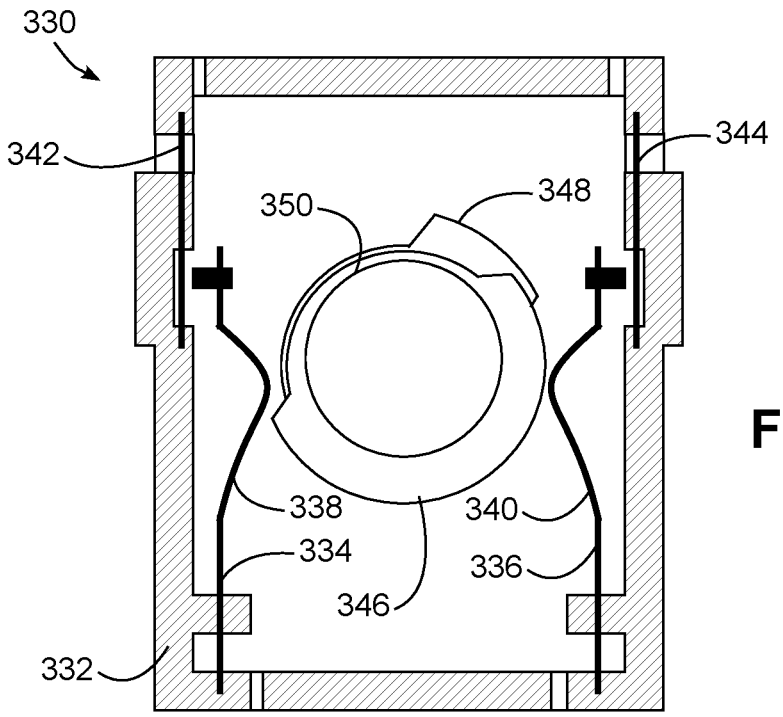
FIG. 7 is a cross-sectional diagram of an example switch configuration for a burner control.

FIG. 7 illustrates an exemplary burner control 330, which includes a housing 332 and a pair of cam-lobe actuated switches 334, 336. Each switch 334, 336 includes a cantilevered leaf 338, 340 biased to a position that is separated from an associated contact 342, 344. A valve stem sleeve 346 may include a pair of cam lobes 348, 350 that are respectively configured to engage leaves 338, 340 to close the switches 334, 336 in the appropriate ranges. Switch 334 may be used, for example, to control the igniter, while switch 336 may be configured to change state at the point gas begins flowing from the gas valve to the burner (e.g. range two in FIGS. 5 and 6) and remain on throughout the ignition and operational ranges (e.g. ranges two, three, and four in FIGS. 5 and 6). In some embodiments, switch 336 may be used to control an on indicator for the burner that indicates that the burner control is an on position. Further, in such a two-switch system, a control circuit may determine the directionality of the movement of the burner control based upon the sequence in which the two switches are activated, since when the burner control is turned on, switch 336 will not be activated when switch 334 is initially activated, while when the burner control is being turned off, switch 336 will already be activated when switch 334 is initially activated.

In some implementations, the control circuit may utilize a timer to determine if the burner control has been in a particular range referred to herein as an ignition range (e.g., range two, range three, range two and range three, or some range that at least partially overlaps range two and/or range three) for a time that meets a predetermined alert criterion. This may be done, for example, by the timer determining how long switch 334 is in a particular state (e.g., an on state in the case of a normally open switch, or an off state in the case of a normally closed switch). Thus, for example, in some embodiments, the ignition range of positions may be represented by the range of positions in which switch 334 is in an on state.

Figure 8:
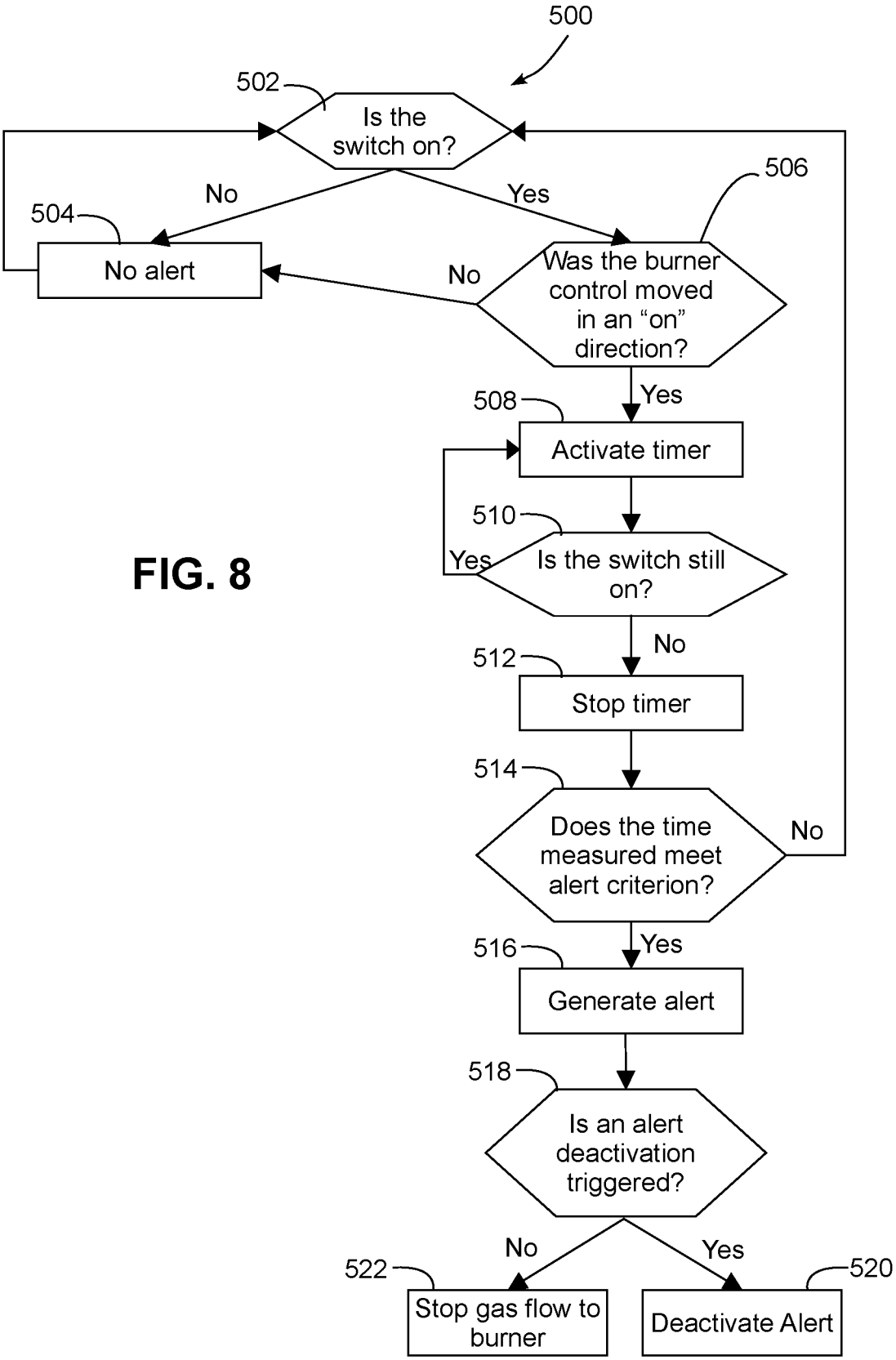
FIG. 8 is a flowchart illustrating an example sequence of operations for indicating an unintentional control activation and other operational states consistent with some embodiments of the invention.

However, as described in detail with respect to FIG. 8, in some embodiments an alert may only be generated when switch 336 was in an off state when switch 334 transitioned to an on state (indicating the ignition range was entered). If switch 336 is on when switch 334 detects movement of the burner control into the ignition range, the burner control may have already been in an operational position and the user may simply be turning the burner control off, and there is therefore no need for an alert. In some embodiments, the range of positions where the burner control is considered to be on may be considered to be an active range of positions (e.g., range four, or ranges three and four, ranges two, three and four, or some range that at least partially overlaps one or more of ranges two, three and four). In some embodiments, for example, the active range of positions may be represented by the range of positions in which switch 336 is in an on state.

The timer utilized may be either a software or a hardware defined timer. In some instances, the measured amount of time is compared to a predetermined alert criterion. An alert device (which may be any of the various types of audio and/or visual devices described above) is activated when the predetermined alert criterion is met. Table I, for example, illustrates one exemplary suitable switch configuration:

TABLE I

| Range | Range in Degrees | Switch 334 | Switch 336 | Igniter | Gas Flow | Timer On |
|---|---|---|---|---|---|---|
| 1 | 0 to 20 | OFF | OFF | NO | NO | NO |
| 2-3 | 20 to 85 | ON | ON | YES | Small through High Flow | YES |
| 4 | 85 to 270 (End of Rotation) | OFF | ON | NO | Operational Flow | NO |

In another example embodiment, a single switch system may be used. Similar to the previously described embodiment, a control circuit may utilize an igniter that is controlled by a switch that controls the activation of igniter. A control circuit may determine if the burner control has been in a particular range (e.g. range two and/or three) for a time that meets a predetermined alert criterion. In some implementations, such a determination may be made with the aide of a timer measuring the length of time the single switch is on, and comparing the measured time to a predetermined alert criterion. An alert device (which may be any of the various types of audio and/or visual devices described above) may be activated when the predetermined alert criterion is met.

An example sequence of operations 500 that may be implemented by a controller to generate an unintentional control activation alert is illustrated in FIG. 8. The sequence 500 begins in block 502 by determining whether a switch, which may control the activation of an ignitor, is on. If it is determined that the switch is not on, control passes to block 504, where no alert is activated. Control may then return to block 502 where the process repeats. If it is determined that the switch is on, control passes to block 506, where it is determined whether the burner control was moved in an "on" direction, or in other words moved away from an off position (e.g., toward the operational range), rather than on "off" direction where movement is toward the off position. In some implementations, the determination of the direction of movement of the burner control may be made by determining the state of a second switch (e.g. switch 336 of FIG. 7). When the second switch is in an off state when the first switch is activated, the burner control is moving in an "on" direction. In other implementations, for example single-switch systems, an encoder or other suitable sensor capable of detecting direction of movement may be user to determine the direction of movement for the burner control. Where the burner control is not moving in an "on" direction (e.g., a user is turning the burner control off), then no alert is provided, block 504. Where the burner control is moving in an "on" direction, however, a timer is activated, at block 508.

The timer remains active until the first switch (for example, the ignition switch) transitions to an off state, at block 510. Once it is determined that the switch has moved to an off state, block 510, the timer is stopped, block 512. At block 514, it may be determined if the time measured by the timer (e.g. in blocks 508-512) meets a predetermined alert criterion. The predetermined alert criterion may be, for example, set to indicate to a user that the burner control (e.g. knob/slider) moved through the ignition state too fast and the flame was not lit. In such an instance, the alert criterion may be when the time measured is less than a particular predetermined length of time. In other instances, the predetermined alert criterion may be, for example, set to indicate to a user that the burner control (e.g. knob/slider) has remained in the ignition state (e.g. ranges two and three in FIGS. 5 and 6) for too long, which may indicate an inadvertent movement of the knob/slider into the ignition state. In such an instance, the alert criterion may be when the time measured is longer than a particular predetermined length of time. In still other instances, the predetermined alert criterion may combine the two previously discussed instances, allowing for an alert criterion to be met when the time in the ignition state is either longer or shorter than a range of times that is indicative of intentional burner control movement by a user. In some instances, the user may be able to adjust the alert criterion (e.g., using a touchscreen, user interface, mobile app, etc.) including, but not limited to, adjusting the predetermined length of time required in order to generate an alert.

If, at block 514, the time measured does not meet a predetermined alert criterion, control may return to block 502, where the sequence 500 may begin again. If, at block 514, it is determined that the time measured meets the predetermined alert criterion, an alert may be generated, at block 516. The alert may be any of a variety of signals and/or warnings (e.g., audible/acoustic, visual, light, display message, user interface, haptic alert, or a combination thereof) and may be directed to the user through the cooking appliance, smart home device, mobile device, etc.

In some instances, when the alert has been triggered under one or more of the different scenarios noted above, the user may deactivate the alert through various actions. As a non-limiting example, deactivation of the alert may be achieved by moving the burner control to the off position, thus eliminating the flow of gas. In another non-limiting example, the alert may be deactivated by actuating a button or switch. Alternatively, or in addition to the herein described actions, a variety of other user actions or appliance conditions may deactivate the alert.

The controller may, in some instances, be configured to keep the generated alert active for a predetermined period of time (e.g., 15 seconds, 30 seconds, etc.); in some instances, this predetermined period of time may be adjustable by a user. At optional block 518, it may be determined if an alert deactivation, as described above, has been activated. The user may use an alert deactivation as described above to deactivate the generated alert, block 520. If no alert deactivation is detected, at block 522, gas flow to the burner may be disabled, e.g., by shutting off a master valve to the cooking appliance. In some instances, the generated alert may persist until the user takes an action to stop the alert.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03. It should be understood that certain expressions and reference signs used in the claims pursuant to Rule 6.2(b) of the Patent Cooperation Treaty ("PCT") do not limit the scope.

What is claimed is:

1. A cooking appliance, comprising:

a gas cooking element;

an igniter disposed adjacent to the gas cooking element to ignite the gas cooking element;

a gas valve configured to regulate gas flow to the gas cooking element;

a burner control coupled to the gas valve to vary the gas flow to the gas cooking element; and a control circuit coupled to the burner control and configured to activate the igniter when the burner control is positioned within a predetermined range of positions, the control circuit further configured to detect when the burner control has been moved through the predetermined range of positions in less than a predetermined time, and in response to determining that the burner control has been moved through the predetermined range of positions in less than the predetermined time, generate an alert to a user.

2. The cooking appliance of claim 1, wherein the burner control is a rotary control knob rotatable within the range of positions.

3. The cooking appliance of claim 1, wherein the control circuit is further configured to adjust the predetermined time based on user input.

4. The cooking appliance of claim 1, wherein the control circuit includes a switch that switches between first and second states, the switch coupled to the burner control and configured to be in the first state when the burner control is in the predetermined range of positions and to be in the second state when the burner control is not in the predetermined range of positions, and wherein the control circuit is configured to detect when the burner control has been moved through the predetermined range of positions in less than the predetermined time by determining a time that the switch is in the first state.

5. The cooking appliance of claim 4, wherein the predetermined range of positions is an ignition range of positions, and wherein the switch is configured to activate the igniter when the burner control is in the ignition range of positions.

6. The cooking appliance of claim 5, wherein the switch is a first switch and the control circuit includes a second switch that switches between first and second states, the second switch coupled to the burner control and configured to be in the first state when the burner control is in an active range of positions for the burner control and to be in the second state when the burner control is not in the active range of positions.

7. The cooking appliance of claim 6, wherein the second switch is configured to activate an on indicator when the burner control is in the active range of positions.

8. The cooking appliance of claim 6, wherein the control circuit is configured to generate the alert only when the control circuit detects that the second switch is in the second state when the burner control moves into the ignition range of positions.

9. The cooking appliance of claim 4, wherein the control circuit includes a timer configured to detect a time that the switch is in the first state.

10. The cooking appliance of claim 1, wherein the control circuit is further configured to detect a direction of movement of the burner control and to generate the alert only when the direction of movement indicates that the burner control is being turned in a first direction.

11. The cooking appliance of claim 1, wherein the control circuit is further configured to, in response to determining that the burner control has been moved through the predetermined range of positions in less than the predetermined time, disable flow of gas to the gas cooking element from the gas valve.

12. The cooking appliance of claim 1, wherein the control circuit is further configured to:

keep the alert actuated for a second predetermined time;

determine whether an alert deactivation is triggered during the second predetermined time; and where no alert deactivation is triggered during the second predetermined time, disable the gas cooking element.

13. The cooking appliance of claim 1, wherein the control circuit is configured to generate the alert by generating an audible alert.

14. The cooking appliance of claim 1, wherein the control circuit is configured to generate the alert by generating a visual alert.

15. A cooking appliance, comprising:

a gas cooking element;

an igniter disposed adjacent to the gas cooking element to ignite the gas cooking element;

a gas valve configured to regulate gas flow to the gas cooking element;

a burner control coupled to the gas valve to vary the gas flow to the gas cooking element; and a control circuit coupled to the burner control and configured to activate the igniter when the burner control is positioned within a predetermined range of positions, the control circuit further configured to detect a time the burner control is in the predetermined range of positions, and in response to determining that the time the burner control is in the predetermined range of positions meets an alert criterion, generate an alert to a user;

wherein the control circuit is further configured to detect a direction of movement of the burner control and to generate the alert only when the direction of movement indicates that the burner control is being moved in a first direction.

16. A cooking appliance, comprising:

a gas cooking element;

an igniter disposed adjacent to the gas cooking element to ignite the gas cooking element;

a gas valve configured to regulate gas flow to the gas cooking element;

a burner control coupled to the gas valve to vary the gas flow to the gas cooking element; and a control circuit coupled to the burner control and configured to activate the igniter when the burner control is positioned within a predetermined range of positions, the control circuit further configured to detect a time the burner control is in the predetermined range of positions, and in response to determining that the time the burner control is in the predetermined range of positions meets an alert criterion, generate an alert to a user;

wherein the control circuit includes a switch that switches between first and second states, the switch coupled to the burner control and configured to be in the first state when the burner control is in the predetermined range of positions and to be in the second state when the burner control is not in the predetermined range of positions, and wherein the control circuit is configured to detect the time the burner control is in the predetermined range of positions by determining a time that the switch is in the first state.

17. The cooking appliance of claim 15, wherein the alert criterion is a predetermined length of time, and wherein the control circuit is configured to determine that the time the burner control is in the predetermined range of positions meets the alert criterion by determining that the burner control has been moved through the predetermined range of positions in less than the predetermined length of time.

18. The cooking appliance of claim 15, wherein the alert criterion is a predetermined length of time, and wherein the control circuit is configured to determine that the time the burner control is in the predetermined range of positions meets the alert criterion by determining that the burner control has been in the predetermined range of positions for longer than the predetermined length of time.

19. The cooking appliance of claim 15, wherein the control circuit is further configured to, in response to determining that the time the burner control is in the predetermined range of positions meets the alert criterion, disable flow of gas to the gas cooking element from the gas valve.

* * * * *